United States Patent [19]

Sasaki et al.

[11] 4,065,297

[45] Dec. 27, 1977

[54] PROCESS FOR DEPHOSPHORIZING MOLTEN PIG IRON

[75] Inventors: Kantaro Sasaki; Takami Ikeda; Tohru Matsuo; Takashi Okazaki, all of Amagasaki, Japan

[73] Assignee: Sumitomo Metal Industries Limited, Japan

[21] Appl. No.: 756,968

[22] Filed: Jan. 4, 1977

Related U.S. Application Data

[63] Continuation-in-part of Ser. No. 727,517, Sept. 28, 1976, abandoned.

[51] Int. Cl.[2] ..... C21C 7/02

[52] U.S. Cl. ..... 75/52; 75/53; 75/56; 75/58

[58] Field of Search ..... 75/51, 52, 53, 58, 60

[56] References Cited

U.S. PATENT DOCUMENTS

| | | | |
|---|---|---|---|
| 3,771,998 | 11/1973 | Knuppel | 75/52 |
| 3,782,921 | 1/1974 | Glaesener | 75/58 |
| 3,807,988 | 4/1974 | Nilles | 75/52 |
| 3,824,095 | 7/1974 | Ando | 75/61 |

*Primary Examiner*—Peter D. Rosenberg
*Attorney, Agent, or Firm*—Watson, Cole, Grindle & Watson

[57] ABSTRACT

A process for dephosphorizing molten pig iron by adding (a) lime, converter slag and/or iron oxide, (b) iron oxide and/or oxidizing gas, and if necessary (c) flourspar and/or soda ash to the molten pig iron stored in a treating vessel in order to adjust the amount of % CaO to correspond to 0.3 to 3.0 times the sum of the amounts of % $SiO_2$ and % $P_2O_5$ and to adjust the amount of total iron to 15 to 50%, in the slag composition after treatment, thereby obtaining a high dephosphorization.

11 Claims, No Drawings

PROCESS FOR DEPHOSPHORIZING MOLTEN PIG IRON

The present application is a Continuation-in-part Application of Application Serial No. 727,517 filed on September 28, 1976, now abandoned.

BACKGROUND OF THE INVENTION

1. FIELD OF THE INVENTION:

The present invention relates to a process for dephosphorizing molten pig iron. More specifically, it relates to a process for lowering the phosphorus content with a small decarburization amount of 1.5 wt.% or less, by treating molten pig iron at less than 1,450° C prior to charging it into a steel-making furnace.

2. DESCRIPTION OF THE PRIOR ART:

It has been known for a long time that phosphorus in steel is a harmful impurity since it causes temper brittleness and it lowers the product toughness. For this reason, dephosphorization of steel has been an important problem in steel production. It is no exaggeration to say that the progress of the steel-making process has been directly related to the progress of the dephosphorization process. However, the steel-making process has changed little since the invention of the LD converter after World War II which provides for a high dephosphorization rate. It is now the main technique in the steel-making process.

However, in recent years the kinds of steel requiring high toughness such as steel sheet for low temperature use and high tension steel have become more important, and these steels cannot contain phosphorus in amounts of more than 0.010 to 0.015 wt.%.

It is difficult to produce such low phosphorus steel by the normal single slag converter oxidation smelting technique, and thus a double slag converter oxidation smelting technique has been employed.

According to the condition of the raw materials, there are instances where pig iron containing phosphorus in amounts of far more than only 0.1 to 0.2 wt.% is used, and in such cases the double slag technique has to be employed if steel conforming to the severe phosphorus standard as mentioned above is to be produced, or even if ordinary steel containing not more than 0.035 wt.% of phosphorus is to be produced.

However, the double slag technique involves grave problems due to disadvantages such as the drop of converter productivity caused by long smelting time, the drop of the iron yield caused by intermediate slagging off, etc.

SUMMARY OF THE INVENTION

The primary object of the present invention is to provide a process for preliminarily dephosphorizing molten pig iron before charging it into a steel-making furnace. It is a further object of the present invention to provide for the production of steel with low phosphorus content even by the single slag converter oxidation smelting technique. Thus, the present invention overcomes the above-mentioned disadvantages of the double slag technique.

According to the process of the present invention, (a) dephosphorizing agents are added to the molten pig iron to adjust the amount of % CaO to correspond to 0.3 to 3.0 times the sum of the amounts of % $SiO_2$ and % $P_2O_5$ and to adjust the amount of Total iron to 15 to 50% in terms of the dephosphorized slag composition after treatment, and, in addition, (b) iron oxide and/or oxidizing gas corresponding to not more than the amount of oxygen required to oxidize all the amounts of silicon, manganese and phosphorus and up to 1.5 wt.% of the carbon contained in the molten pig iron before treatment are added to the molten pig iron before it is charged into the steel-making furnace. The dephosphorizing agents and oxidizing agents are made to come into contact with the molten pig iron with stirring to lower the phosphorus content with a small decarburization amount of 1.5 wt.% or less.

DETAILED DESCRIPTION OF THE INVENTION

In the dephosphorization of molten pig iron, phosphorus is surmised to be absorbed and removed by slag as oxide. However, since phosphorus has less affinity for oxygen than silicon and manganese in molten pig iron, sufficient oxidizing power to almost completely oxidize silicon and manganese must be provided for effective dephosphorization. Such strong oxidizing power, however, causes concurrent decarburization.

In the pretreatment of molten pig iron before charging it into the steel-making furnace, it is desirable to keep the decarburization amount as small as possible. In fact the amount must be suppressed to 1.5 wt.% or less in light of equipment conditions as well as the safety of the heat source in the following step in the converter.

This can be achieved by treating the molten pig iron at less than 1,450° C. The treatment at a temperature of more than 1,450° C causes active decarburization; however, it does not allow for the attainment of a high dephosphorization with a decarburization amount of 1.5 wt.% or less. A lower treatment temperature of below 1,450° C allows for a more effective dephosphorization with a smaller decarburization. For example, treatment at 1,300° C allows for the attainment of a high dephosphorization with a small decarburization of 0.4 to 0.7 wt.%.

As mentioned above, in dephosphorization the phosphorus is absorbed and removed by the slag as oxide. In this case, the slag basicity represented by $\%CaO/(\%SiO_2 + \%P_2O_5)$ and the oxidizing power of the slag represented by Total iron are important factors. That is, the higher the slag basicity and Total iron, the higher the dephosphorization which can be attained.

However, if the oxidizing power is provided mainly by an oxidizing gas as in the conventional steel-making process, the temperature rises greatly, thus not allowing for the treatment at less than 1,450° C, and decarburization is caused. This does not provide for a high Total iron in the slag of 15% or more (due to a high carbon content).

In the case of the present invention, if the oxidizing power is provided mainly by iron oxide, the treatment can be held at less than 1,450° C, keeping the decarburization amount small, and the Total iron of the slag can be obtained at 15% to 50%.

Furthermore, the low temperature treatment is advantageous for dephosphorization also because the thermodynamics allows for dephosphorization at a low basicity which would be inconceivable in the steel-making process. If the treatment temperature is as low as 1,300° C, the slag Total iron of 40 to 50% allows the dephosphorization of 40 to 60% even with a basicity of 0.3. However, if the basicity becomes smaller than 0.3, effective dephosphorization cannot be made, however high the Total iron in the slag may be. Of course, the higher the basicity of the slag, the more effective the dephosphorization is. If the Total iron in the slag is 15% or more in this treatment process at less than 1,450° C, a basicity of 3.0 allows for sufficient dephosphorization, and a basicity higher than it is not required. From the above, it can be said that the dephosphorized slag in the range from 0.3 to 3.0 in basicity and in the range from 15 to 50% in Total iron is the most suitable for this process.

For dephosphorization of molten pig iron with such dephosphorizing slag, it is necessary, as mentioned above, to provide sufficient oxygen to oxidize all the amounts of silicon and manganese with stronger affinity for oxygen than phosphorus so as to oxidize the silicon, manganese and phosphorus, and less than about 1.5 wt.% of the carbon. If oxygen or any other oxidizing gas is used as the only oxygen source, the temperature rise by the treatment is great. Therefore, unless the temperature of the molten pig iron before treatment is as low as about 1,200° C, it is difficult to keep the temperature of the molten pig iron at less than 1,450° C during treatment. On the contrary, if the oxygen is provided by iron oxide such as iron ores or scale, the temperature drop by the treatment is great. Therefore, unless the temperature of the molten pig iron is more than about 1,450° C, it is difficult to keep the temperature of the molten pig iron at more than 1,250° C after treatment. For dephosphorization of molten pig iron which does not meet the above temperature conditions, iron oxide, such as iron ores or scale, and an oxidizing gas, such as oxygen, must be used together as the oxygen source.

The dephosphorizing agents for producing dephosphorizing slag must comprise CaO and iron oxide as mentioned above.

When sufficient dephosphorization can be obtained at the relatively low basicity as in the process of the present invention, LD converter slag can in part be used as the CaO and iron oxide source. In addition, if limestone is used as the CaO source, it is changed into CaO at the treatment temperature, and quick lime itself can of course be used. From the above, the dephosphorizing agents can be (1) LD converter slag and iron oxide such as iron ores or scale, (2) limestone and iron oxide such as iron ores or scale, and (3) quick lime and iron oxide such as iron ores or scale. When these dephosphorizing agents and oxidizing agents are used for dephosphorization, the slagging of these additions is very important. If the mixture poses difficulty in slagging, the addition of fluorspar and/or soda ash promotes slagging.

When these ingredients are used for dephosphorization, the stirring of the molten pig iron and dephosphorizing agents or dephosphorizing slag is important for sufficient reaction and for shortening of the treatment time. As a means of stirring, an impeller is the most effective, but bubbling by using an inert gas such as nitrogen, argon, etc., or air can be used, too, for stirring.

When oxidizing gas is supplied to the molten pig iron, and if the dephosphorizing slag layer is thick, it can be supplied through an immersion pipe; but if the dephosphorizing slag layer is relatively thin, it may be blown into molten pig iron through the slag by using a water-cooled lance.

This dephosphorizing treatment of molten pig iron can be performed in a ladle used for charging molten pig iron into a converter, and this method is advantageous for skimming of slag after treatment and for charging into the converter. The treatment of molten pig iron in a torpedo car can be performed effectively, too.

Embodiments of the present invention will be given below.

EMBODIMENT I

With 45 tons (t) of molten pig iron stored in a ladle, 30kg/t of converter slag and 40kg/t of scale were added to the molten pig iron as dephosphorizing agents, and further 35kg/t of scale was added. While 7.2Nm3/t of oxidizing gas was blown into the molten pig iron by using an immersion pipe, the mixture was stirred by an impeller at 100rpm. The results as shown in Table 1 were obtained.

Table 1

| | | | | | |
|---|---|---|---|---|---|
| Temperature of molten pig iron before treatment | 1,320° C | | | | |
| Temperature of molten pig iron after treatment | 1,275° C | | | | |
| Components of molten pig iron before treatment (% by wt.) | C | Si | Mn | P | S |
| | 4.06 | 0.82 | 0.50 | 0.112 | 0.025 |
| Components of molten pig iron after treatment (% by wt.) | C | Si | Mn | P | S |
| | 3.53 | trace | trace | 0.023 | 0.027 |
| Components of dephosphorized slag | $\%CaO/(\%SiO_2 + \%P_2O_5) = 0.37$ | | | | |
| | Total iron = 41.1% | | | | |
| Treatment time | 35 min. | | | | |

As shown above, the treatment in the range from 1,275 to 1,320° C allowed for a high dephosphorization amount of 79% with a small decarburization amount of 0.53 wt.%.

EMBODIMENT II

With 45t of molten pig iron stored in a ladle, 30kg/t of quick lime and 25kg/t of iron ore as dephosphorizing agents and 10kg/t of fluorspar as a slagging promoter were added to the molten pig iron and further 20kg/t of iron ore was added. While 10.2Nm³/t of oxygen was blown through an immersion pipe, $N_2$ bubbling was performed for stirring by using another immersion pipe. The results as shown in Table 2 were obtained.

Table 2

| | | | | | |
|---|---|---|---|---|---|
| Temperature of molten pig iron before treatment | 1,350° C | | | | |
| Temperature of molten pig iron after treatment | 1,370° C | | | | |
| Components of molten pig iron before treatment (% by wt.) | C | Si | Mn | P | S |
| | 4.07 | 0.64 | 0.59 | 0.113 | 0.012 |
| Components of molten pig iron after treatment (% by wt.) | C | Si | Mn | P | S |
| | 3.54 | trace | 0.13 | 0.015 | 0.013 |
| Components of dephosphorized slag | $\%CaO/(\%SiO_2 + \%P_2O_5) = 1.79$ | | | | |
| | Total iron = 15.8% | | | | |
| Treatment time | 40 min. | | | | |

As shown above, the treatment in the range from 1,350° to 1,370° C allowed for a high dephosphorization amount of 87% with a small decarburization amount of 0.53 wt.%.

EMBODIMENT III

With 41.5t of molten pig iron stored in a ladle, 30kg/t of limestone and 32kg/t of iron ore were added to the molten pig iron as dephosphorizing agents, and further 20kg/t of iron ore was added. As 11.5Nm³/t of oxygen gas was blown into the molten pig iron by using a water-cooled lance, the mixture was stirred by an impeller at 100rpm. The results as shown in Table 3 were obtained.

Table 3

| | | | | | |
|---|---|---|---|---|---|
| Temperature of molten pig iron before treatment | 1,370° C | | | | |
| Temperature of molten pig iron after treatment | 1,345° C | | | | |
| Components of molten pig iron before treatment (% by wt.) | C | Si | Mn | P | S |
| | 4.18 | 0.72 | 0.48 | 0.121 | 0.032 |
| Components of molten pig iron after treatment (% by wt.) | C | Si | Mn | P | S |
| | 3.56 | trace | 0.07 | 0.021 | 0.030 |
| Components of dephosphorized slag | $\%CaO/(\%SiO_2 + \%P_2O_5) = 0.92$ | | | | |
| | Total iron = 36.2% | | | | |
| Treatment time | 37 min. | | | | |

As shown above, the treatment in the range from 1,370° to 1,345° C allowed for a high dephosphorization amount of 82.6% with a small decarburization rate of 0.62 wt.%.

Having thus described the invention what is claimed is:

1. A process for dephosphorizing molten pig iron prior to charging it into a converter so as to obtain pig iron having a low phosphorus content, the process including 1. forming a slag by
   a. adding a dephosphorizing agent to the molten pig iron when the pig iron is at a temperature of less than 1450° C;
   b. adding an oxidizing agent to the molten pig iron when the pig iron is at a temperature of less than 1450° C; and
2. removing the slag;

said steps (1) (a) and (1) (b) being such as to form a slag having a % CaO in an amount which corresponds to 0.3 to 3.0 times the sum of the amounts of % $SiO_2$ and % $P_2O_5$, and a total iron of 15 to 50%.

2. A process according to claim 1, wherein said added dephosphorizing agent is selected from the group consisting of iron oxide, converter slag, limestone and lime.

3. The process according to claim 1, wherein said added oxidizing agent is selected from the group consisting of iron oxide, oxygen gas and mixtures thereof.

4. The process according to claim 1, wherein in forming said slag a further step (1) (c) of adding at least one slagging promoter to the molten pig iron is included.

5. The process according to claim 4, wherein said added at least one slagging promoter is selected from the group consisting of fluorspar and soda ash.

6. The process according to claim 4, wherein said slagging promoter is added to said molten pig iron in an amount up to 15kg per ton of pig iron.

7. The process according to claim 1, wherein said oxidizing agent is added to said pig iron in an amount which oxidizes all the Si, Mn and P contained in said pig iron but no more than 1.5 wt.% of the carbon.

8. The process according to claim 1, wherein said oxidizing agent is an oxidizing gas which is added to said molten pig iron by passage through an immersion pipe.

9. The process according to claim 1, wherein said oxidizing agent is an oxidizing gas which is added to said molten pig iron by being blown onto the surface of the molten pig iron by a lance.

10. The process according to claim 1, wherein said dephosphorizing agent and said oxidizing agent are added to said molten pig iron while said molten pig iron is stirred by bubbling an inert gas therethrough.

11. The process according to claim 1, wherein said dephosphorizing agent and said oxidizing agent are added to said molten pig iron while said molten pig iron is stirred by an impeller.

* * * * *